US006520432B2

(12) United States Patent
Molnar

(10) Patent No.: US 6,520,432 B2
(45) Date of Patent: Feb. 18, 2003

(54) LASER WELDING STAINLESS STEEL COMPONENTS BY STABILIZED FERRITIC STAINLESS STEEL FUSION ZONE MODIFIERS

(75) Inventor: James R. Molnar, Penfield, NY (US)

(73) Assignee: Delphi Technologies, Inc., Troy, MI (US)

( * ) Notice: Subject to any disclaimer, the term of this patent is extended or adjusted under 35 U.S.C. 154(b) by 112 days.

(21) Appl. No.: 09/782,730

(22) Filed: Feb. 13, 2001

(65) Prior Publication Data

US 2002/0109024 A1 Aug. 15, 2002

(51) Int. Cl.[7] ..... F02M 51/00
(52) U.S. Cl. ..... 239/585.1; 29/890.142
(58) Field of Search ..... 239/533.3–533.12, 239/585.1–585.5; 219/121.64; 29/890.142

(56) References Cited

U.S. PATENT DOCUMENTS 5,296,677 A * 3/1994 Takahashi et al. ..... 219/146.23
5,628,449 A 5/1997 Onuma et al.
5,837,960 A * 11/1998 Lewis et al. ..... 219/121.63
6,204,477 B1 * 3/2001 Lai ..... 219/136

* cited by examiner

*Primary Examiner*—Lesley D. Morris
(74) *Attorney, Agent, or Firm*—Patrick M. Griffin

(57) ABSTRACT

A process of laser welding high carbon martensitic stainless steel components and austenitic stainless steel components by a stabilized ferritic stainless steel fusion zone modifier in the weld joint, and articles formed therefrom. The stabilized ferritic stainless steel fusion zone modifier comprises, in terms of weight percentage, from about 10% to about 35% chromium, and at least one element selected from the group consisting of no more than about 1.5% titanium and no more than about 1.5% columbium. The stabilized ferritic stainless steel fusion zone modifier present in the fusion zone inhibits and prevents solidification cracks and micro-fissures from forming in the weld joint, and assists immunity to environmental degradation.

16 Claims, 3 Drawing Sheets

LASER WELDING STAINLESS STEEL COMPONENTS BY STABILIZED FERRITIC STAINLESS STEEL FUSION ZONE MODIFIERS

TECHNICAL FIELD

The present invention relates to laser welding stainless steel components, in particular, laser welding high carbon martensitic stainless steel components and austenitic stainless steel components together by a stabilized ferritic stainless steel fusion zone modifier in the weld portion.

BACKGROUND OF THE INVENTION

In a common laser welding process, metallic members are assembled with bonding surfaces in juxtaposition, for example, to form a butt joint, and one outer surface is scanned with a continuous laser beam to melt and fuse the members at the bonding surfaces. In contrast to other welding processes such as electrical resistance welding that generate heat concentrated at the bonding surfaces, laser welding heats a zone extending from the irradiated surface down below the touching surfaces to create a pool of molten metal within both members that, upon solidification, forms the weld nugget that joins the two metallic members together.

When high carbon martensitic stainless steel and austenitic stainless steel are laser welded together, the molten material in the fusion zone will be primarily an austenitic phase initially. Unless approximately a minimum of 3–5% delta ferrite is present during the solidification process, the potential for encountering micro-fissures or solidification cracks is high in the solidified fusion zone. As the cause of micro-fissures or solidification cracks is related to the absence of delta ferrite, it is necessary to balance the chemical compositions of the fusion zone to promote the presence of delta ferrite. Elements contained in each respective alloy to be welded can be balanced to produce a fusion zone devoid of micro-fissures or solidification cracks.

In order to obtain a weld portion having soundness and reliability between different types of metallic materials laser welded together, such as laser welding a high carbon martensitic stainless steel and an austenitic stainless steel together, the composition and structure of the weld material at the joint portion must be controlled. When a high density energy welding method having a small heat input quantity such as laser welding is used, the welding width and the depth of penetration is small. Because the melt quantity is small, it is expected that the absolute formation quantity of the fusion zone will contain sufficient content of delta ferrite when sufficient mixing and proper chemical balance is achieved. Accordingly, it is expected that laser welding different types of metallic materials together by obtaining a weld portion having sufficient soundness and reliability can be achieved by controlling the solidified structure formed in the weld portion. Attempts have been made in the prior art to attain an improved weld when laser welding different types of metallic materials together.

One attempt at laser welding different types of metallic materials together is disclosed in U.S. Pat. No. 5,628,449 issued to Onuma et al., wherein a method of laser welding carbon steel and austenitic stainless steel together by an austenitic stainless steel welding material is disclosed. The metallographic structure of the weld portion comprises a mixed structure of an austenitic structure and not greater than 20% of a ferritic structure. The composition of the weld material in Onuma et al. consists of, in terms of weight percentage, not greater than 0.15% of C, not greater than 0.65% of Si, 1.0 to 3.0% of Mn, 10–16% of Ni, 26–32% of Cr, and 1.0 to 5.0% of Mo as an optional component, the balance of Fe, and not greater than 0.02% of P and 0.02% of S as unavoidable impurities. However, Onuma et al. fail to teach laser welding high carbon containing martensitic stainless steel to austenitic stainless steel via a fusion zone modifier consisting of stabilized ferritic stainless steel material in the weld joint, thereby preventing or inhibiting the formation of solidification cracks and micro-fissures in the fusion zone, while maintaining mechanical properties of the weld joint, and some degree of immunity from environmental degradation.

There is a need to develop an improved laser welded fusion zone and laser welding process between two different metallic materials, such as a high carbon martensitic stainless steel, typically containing greater than about 0.8% carbon (expressed in terms of weight percentage), and an austenitic stainless steel, that is less susceptible to the formation of solidification cracks in the fusion zone, while maintaining mechanical properties, and some degree of immunity from environmental degradation. The inventor has developed a laser welding process that incorporates a stabilized ferritic stainless steel fusion zone modifier in a weld portion joining high carbon martensitic stainless steel and austenitic stainless steel via laser welding, capable of solving the aforementioned problems.

SUMMARY OF THE INVENTION

The present invention is directed to a laser welding process for joining high carbon martensitic stainless steel and austenitic stainless steel components by a stabilized ferritic stainless steel fusion zone modifier in the weld portion. The present invention is also directed to a method for preventing or inhibiting solidification cracks from forming in the weld joint portion of metallic materials that exhibit a high potential to form solidification cracks, such as when high-carbon martensitic stainless steel components and austenitic stainless steel components are laser welded together with out employing a stabilized ferritic fusion zone modifier in the weld joint portion.

Another object of this invention to provide a laser welded article comprising a high carbon martensitic stainless steel component and an austenitic stainless steel component laser welded together by a stabilized ferritic stainless steel fusion zone modifier in the weld joint portion in order prevent and/or inhibit solidification cracks from forming in the fusion zone laser weld, and assist immunity to environmental degradation.

It is a further object of this invention to provide improved elements and arrangements thereof for the purposes described which are inexpensive, dependable and fully effective in accomplishing its intended purposes.

These and other objects of the present invention will become readily apparent upon further review of the following specification and drawings.

DESCRIPTION OF THE PREFERRED EMBODIMENTS

Figure 1:
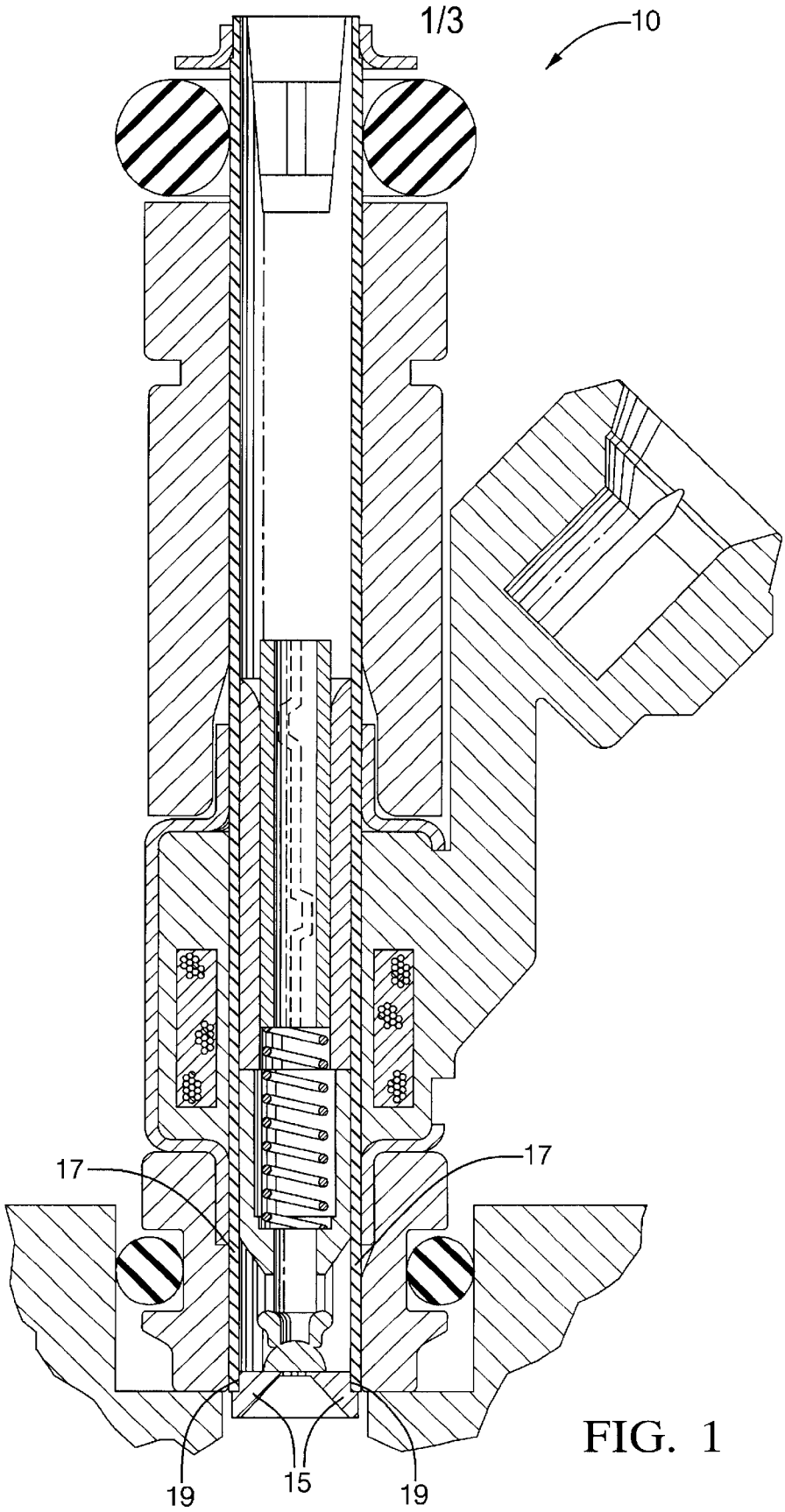
FIG. 1 is a longitudinal cross-sectional view through an automotive fuel injector comprising a high-carbon containing martensitic stainless steel seat material and an austenitic stainless steel fuel-tube are laser welded together by a fusion zone modified by a stabilized ferritic stainless steel fusion zone modifier according to one embodiment of the present invention.

In order to promote desired fusion or weld solidification results between laser welding materials that exhibit a high potential to form solidification cracks, such as welding a high-carbon martensitic stainless steel component, a stainless steel typically containing greater than about 0.8% carbon, expressed in terms of weight percentage, and an austenitic stainless steel component together, a stabilized ferritic stainless material is used as a fusion zone modifier to prevent solidification cracking and micro-fissures from occurring in the laser weld portion. When laser welding high carbon martensitic stainless steel and austenitic stainless steel to one another, the propensity for encountering solidification cracks in the weld bead is high unless the chemistry of weld portion is properly controlled and balanced. Solidification cracking in the welding of stainless steel components is primarily caused by austenite/austenite phase boundaries during the solidification process of the molten weld pool, wherein the presence of delta ferrite during solidification of the molten weld pool will serve to prevent the cracking potential.

In order to prevent and/or inhibit stainless steel alloys that begin solidification as austenite, the inventors have discovered that a ring or other appropriately shaped weld material of stabilized ferritic stainless steel acts as a fusion zone modifier when incorporated into the weld joint prior to commencing laser welding. Subsequent dilution of stabilized ferritic stainless steel material into the fusion zone will provide sufficient delta ferrite formation upon solidification of the weld to prevent micro-fissures and solidification crack formation, and thereby enable the weld joint to maintain some degree of immunity to environmental degradation as well.

As used herein, the phrase "stabilized ferritic stainless steel" fusion zone modifier means a ferritic stainless steel material comprising at least one element selected from the group consisting of titanium and/or columbium, in an amount up to about 1.5% (expressed in terms of weight percentage) of each element, in order to prevent high temperature embrittlement/sensitization during laser welding. Once the weld is "sensitized", it will render the weld and surrounding material more susceptible to intergranular corrosive attack and overall mechanical weakness.

Sensitization is a high temperature embrittlement condition that manifests from rapid precipitation of carbon (C) and nitrogen (N) and the subsequent formation of Cr carbides and nitrides at grain boundaries when heated above about 1,000° C. In order to prevent precipitation of C and N at grain boundaries the stabilized ferritic stainless steel contains titanium and/or columbium. The presence of titanium and/or columbium in the stabilized ferritic stainless steal material act to combine with C and N in solution during the laser welding process and impede precipitation at grain boundaries when heated to sensitization temperatures.

Stabilized ferritic stainless steel material used in the invention contains chromium in a low amount, from about 10% to about 15% chromium (expressed in terms of weight percentage), chromium in a medium amount greater than about 15% but less than about 20%chromium, or chromium in a high amount greater than about 20% but less than about 35%chromium. Preferably, stabilized ferritic stainless steel material comprises about 12% to about 25% chromium, and more preferably, about 12% to about 19% chromium.

Examples of commercially available stabilized ferritic stainless steel material useful in the present invention, include but are not limited to, Armco 18 Cr—Cb and Armco 439 Stainless Steel (formerly Armco Inc., of Butler, Pa., now AK Steel Corporation of Middletown, Ohio), and Allegheny Ludlum Stainless Steel Type 439, also known as ASTM XM-8, and by the UNS designation S43035 (Allegheny Ludlum Corp., of Pittsburgh, Pa.).

In a preferred embodiment, a thin strip, ring or the like of stabilized ferritic stainless steel material, preferably a stamped strip, is placed in the weld joint between the high carbon martensitic stainless steel component and the austenitic stainless steel component. Then, the strip of stabilized ferritic stainless steel material is laser welding into the joint in order to unify the three (3) components. Upon laser welding the stabilized ferritic stainless steel material in the joint, the ferritic stainless steel will be consumed into the fusion zone and act as a fusion zone modifier to prevent solidification cracking and the formation of micro-fissures from forming in the solidified weld. Additionally, stabilized ferritic stainless material used as a fusion zone modifier also assists in minimizing detrimental Cr carbide precipitates as a result of significant carbon introduction resulting from the martensitic stainless steel material, acting to minimize environmental degradation effects.

In a preferred embodiment, an automotive fuel injector having a high-carbon martensitic stainless steel seat material and an austenitic stainless steel fuel-tube are laser welded together via a stabilized ferritic stainless steel material in the weld joint, wherein the stabilized ferritic stainless material is consumed into the fusion zone, thereby preventing and inhibiting solidification cracking and micro-fissures from occurring in the solidified weld.

FIG. 1 depicts this preferred embodiment comprising fuel injector 10, for automotive usage, having high carbon containing martensitic stainless steel seat material 15 and austenitic stainless steel fuel-tube 17 laser welded together by a modified fusion zone 19 comprising stabilized ferritic stainless steel material as a fusion zone modifier. Fuel injector 10, by incorporating stabilized ferritic stainless steel material as a fusion zone modifier, exhibits enhanced resistance to solidification cracking and improved environmental degradation resistance had the stabilizing elements of the stabilized ferritic stainless steel material not been present in the fusion zone.

Figure 4:
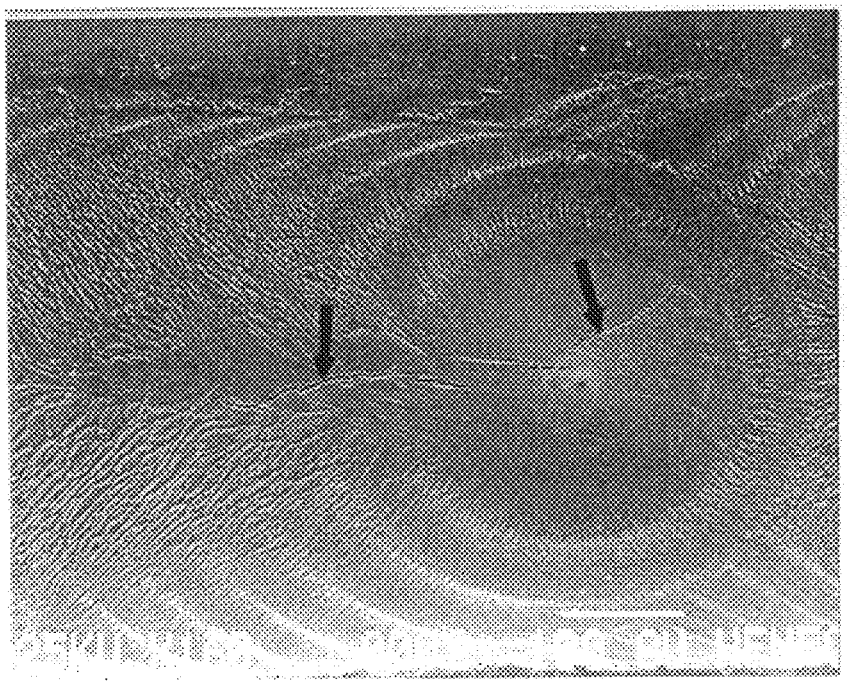
PRIOR ART FIG. 4
FIG. 4 is a SEM photograph (160 times magnification) of a prior art weld bead depicting solidification cracks formed in a weld joint between a carbon containing martensitic stainless steel component and an austenitic stabilized stainless steel component welded together with out a stabilized ferritic stainless steel fusion zone modifier.

FIG. 4 depicts a SEM photograph (160 times magnification) of a typical prior art weld bead depicting solidification cracks formed in the weld joint between the carbon containing martensitic stainless steel component and the austenitic stainless steel component laser welded together with out a modified fusion zone present in the weld.

Figure 2:
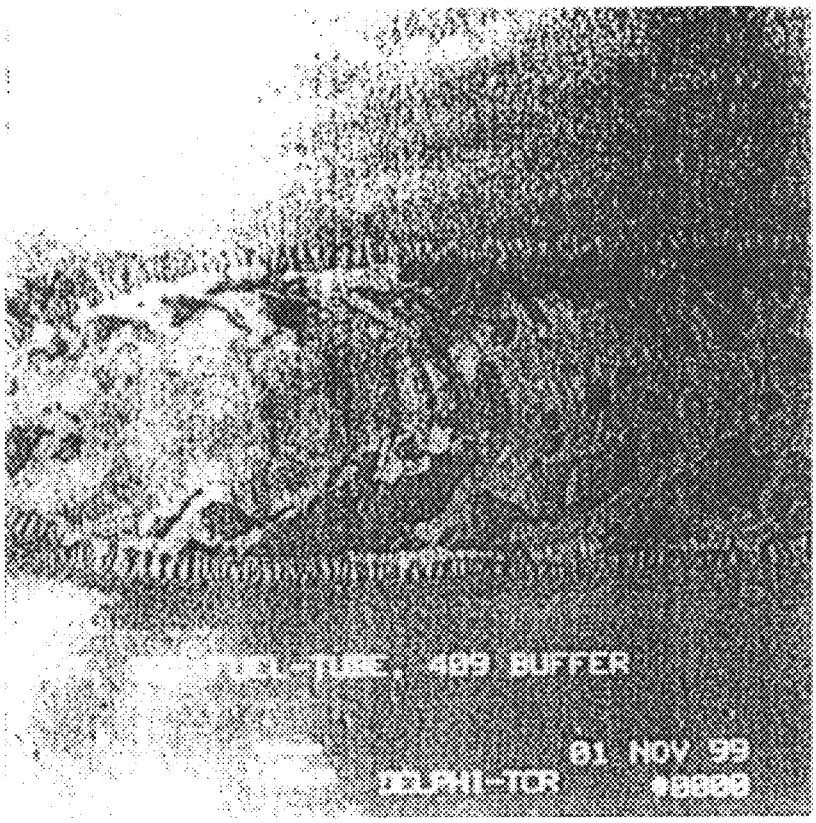
FIG. 2 is a SEM photograph (70 times magnification) of a weld bead produced at a weld joint of a fuel injector having a modified fusion zone in according to one embodiment of the present invention.
Figure 3:
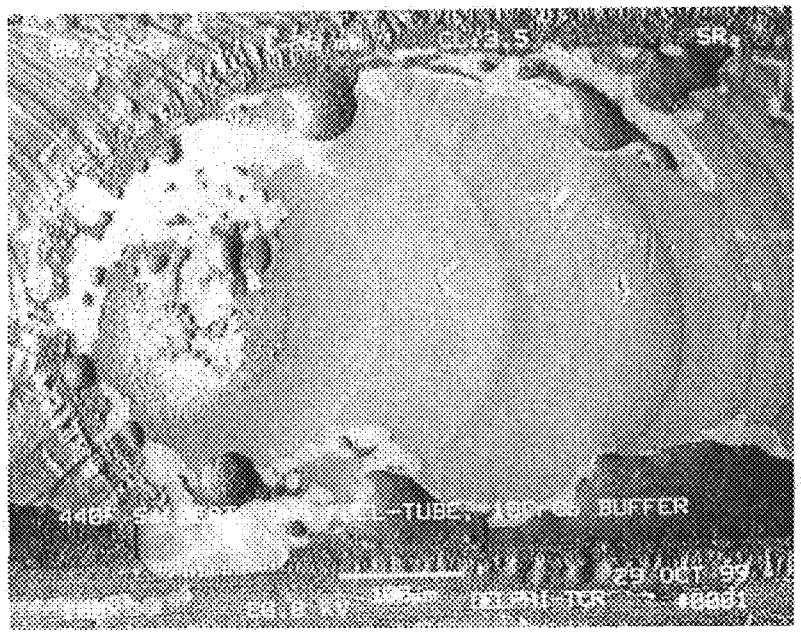
FIG. 3 is a SEM photograph (180 times magnification) of the weld bead shown in FIG. 2.

FIGS. 2 and 3 depict SEM photographs (at two different magnifications) of a representative weld bead joining a high carbon containing martensitic stainless steel seat material and an austenitic stainless steel fuel-tube, for use in an automotive fuel injector like the one depicted in FIG. 1. The weld bead in FIGS. 2, 3 and 5 consists of a fusion zone modified with stabilized ferritic stainless steel material according to the invention, wherein stabilized ferritic stainless steel material in these embodiments comprises, expressed in terms of weight percentage, 0.25% titanium, 0.55% columbium, and 18% chromium, and, unlike the weld joint depicted in FIG. 4, is free of solidification cracks.

The seat material and fuel-tube weldment depicted in FIGS. 2 and 3 were sectioned longitudinally and prepared for metallographic examination to facilitate viewing of the weld profile. Micro etching to highlight the subsurface weld characteristics revealed the fusion zone location, penetration and general geometry. As depicted in FIGS. 2 and 3, the employment of stabilized ferritic stainless steel fusion zone modifier in the fusion zone prevented the formation of solidification cracks in the weld joint.

Figure 5:
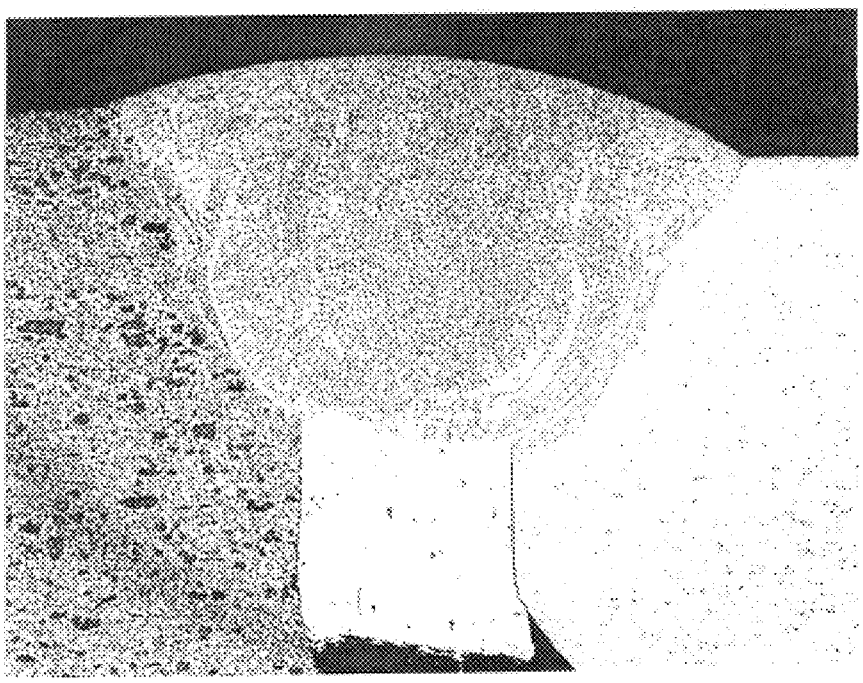
FIG. 5 is a micrograph (200 times magnification) of a longitudinal cross section of a weld joint between a high carbon containing martensitic stainless steel component and an austenitic stainless steel component welded together by a fusion zone modified by a stabilized ferritic stainless steel fusion zone modifier according to one embodiment of the present invention.

FIG. 5 depicts a micrographic longitudinal cross section of the modified fusion zone containing stabilized ferritic fusion zone modifier in a weld joint between high carbon containing martensitic stainless steel seat material and austenitic stainless steel fuel-tube according to the invention. As depicted in FIG. 5, the employment of stabilized ferritic stainless steel fusion zone modifier in the fusion zone prevented the formation of solidification cracks in the weld joint.

The shape, size and dimensions of high carbon containing martensitic stainless steel components, austenitic stainless steel components, and stabilized ferritic stainless steel fusion zone modifier according to the present invention can vary widely, and are determined by the desired end product and end use of the article formed in accordance with the present invention.

While the invention has been described with reference to preferred embodiments, it will be understood by those skilled in the art that various changes may be made and equivalents may be substituted for elements thereof without departing from the scope of the invention. For example, while the preferred embodiments are directed towards high-carbon martensitic stainless steel components, a stainless steel typically containing greater than about 0.8% carbon expressed in terms of weight percentage, it should be noted that the invention is equally applicable to laser welding lower carbon containing martensitic stainless steel components, since lower carbon containing martensitic stainless steel components also suffer from solidification crack and micro-fissure formation during solidification of the weld.

In addition, many modifications may be made to adapt a particular situation or material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. A method of laser welding together a carbon containing martensitic stainless steel component and an austenitic stainless steel component which comprises:

placing a stabilized ferritic stainless steel material between a carbon containing martensitic stainless steel component and an austenitic stainless steel component; and laser welding the stabilized ferritic stainless steel material to form a modified fusion zone in a weld joint formed between the carbon containing martensitic stainless steel component and the austenitic stainless steel component thereby laser welding the carbon containing martensitic stainless steel component and the austenitic stainless steel component together.

2. The method according to claim 1, wherein the stabilized ferritic stainless steel material comprises, in terms of weight percentage, about 10% to about 35% chromium and at least one element selected from the group consisting of titanium and columbium.

3. The method according to claim 1, wherein the stabilized ferritic stainless steel material comprises, in terms of weight percentage, about 12% to about 19% chromium, and at least one element selected from the group consisting of no more than about 1.5% titanium and no more than about 1.5% columbium.

4. The method according to claim 1, wherein the carbon containing martensitic stainless steel component is a high carbon stainless steel comprising, in terms of weight percent, greater than about 0.8% carbon.

5. The method according to claim 1, wherein the carbon containing martensitic stainless steel component comprises a fuel injector seat material and the austenitic stainless steel component comprises a fuel tube for use in an automotive fuel injector.

6. A laser welded article made according to the process of claim 1.

7. A method of inhibiting and preventing the formation of solidification cracks in a laser weld joint formed between a carbon containing martensitic stainless steel component and an austenitic stainless steel component laser welded together which comprises:

placing a stabilized ferritic stainless steel material between a carbon containing martensitic stainless steel component and an austenitic stainless steel component;

laser welding the stabilized ferritic stainless steel material to form a modified fusion zone in a weld joint between the carbon containing martensitic stainless steel component and the austenitic stainless steel component; and laser welding the carbon containing martensitic stainless steel component and the austenitic stainless steel component together.

8. The method according to claim 7, wherein the stabilized ferritic stainless steel material comprises, in terms of weight percentage, about 10% to about 35% chromium and at least one element selected from the group consisting of titanium and columbium.

9. The method according to claim 7, wherein the stabilized ferritic stainless steel material comprises, in terms of weight percentage, about 12% to about 19% chromium, and at least one element selected from the group consisting of no more than about 1.5% titanium and no more than about 1.5% columbium.

10. The method according to claim 7, wherein the carbon containing martensitic stainless steel component is a high-carbon stainless steel comprising, in terms of weight percent, greater than about 0.8% carbon.

11. The method according to claim 7, wherein the martensitic stainless steel component comprises a fuel injector seat material and the austenitic stainless steel component comprises a fuel tube for use in an automotive fuel injector.

12. A laser welded stainless steel article comprising:

a carbon containing martensitic stainless steel component laser welded to an austenitic stainless steel component by a stabilized ferritic stainless steel material located in a weld joint between the carbon containing martensitic stainless steel component and the austenitic stainless steel component.

13. The article according to claim 12, wherein the article comprises an automotive fuel injector;

the carbon containing martensitic stainless steel component comprises a seat material; and the austenitic stainless steel component comprises a fuel-tube.

14. The article according to claim 12, wherein the stabilized ferritic stainless steel material comprises, in terms of weight percentage, about 10% to about 35% chromium and at least one element selected from the group consisting of titanium and columbium.

15. The article according to claim 12, wherein the carbon containing martensitic stainless steel component is a high carbon stainless steel comprising, in terms of weight percent, greater than about 0.8% carbon.

16. The article according to claim 12, wherein the stabilized ferritic stainless steel material comprises, in terms of weight percentage, about 12% to about 19% chromium, and at least one element selected from the group consisting of no more than about 1.5% titanium and no more than about 1.5% columbium.

* * * * *